US009844711B2

(12) United States Patent
Davis et al.

(10) Patent No.: US 9,844,711 B2
(45) Date of Patent: Dec. 19, 2017

(54) FLEXIBLE GRIP AND CAP THEREFOR

(71) Applicant: Eaton Corporation, Cleveland, OH (US)

(72) Inventors: Stephen James Davis, Pinehurst, NC (US); LingYu Hsu, Tainan (TW); Rita Chang, Tainan (TW); Jack Kao, Tainan (TW)

(73) Assignee: EATON CORPORATION, Cleveland, OH (US)

( * ) Notice: Subject to any disclaimer, the term of this patent is extended or adjusted under 35 U.S.C. 154(b) by 0 days.

(21) Appl. No.: 15/098,371

(22) Filed: Apr. 14, 2016

(65) Prior Publication Data

US 2017/0296893 A1 Oct. 19, 2017

(51) Int. Cl.

| | |
|---|---|
| ***A63B 53/14*** | (2015.01) |
| ***A63B 60/08*** | (2015.01) |
| ***A63B 60/16*** | (2015.01) |

(52) U.S. Cl.

CPC ..... *A63B 60/08* (2015.10); *A63B 53/14* (2013.01); *A63B 60/16* (2015.10)

(58) Field of Classification Search

CPC ..... A63B 60/08; A63B 53/14; A63B 60/16; A63B 60/14; A63B 60/12

See application file for complete search history.

(56) References Cited

U.S. PATENT DOCUMENTS

| | | | | |
|---|---|---|---|---|
| 4,195,837 A * | 4/1980 | Poulin | ..... | A63B 49/08 40/317 |
| 7,399,236 B2 * | 7/2008 | Takeuchi | ..... | A63B 53/14 473/300 |
| 2003/0176234 A1 * | 9/2003 | Sheets | ..... | A63B 49/08 473/300 |
| 2007/0259732 A1 * | 11/2007 | Billings | ..... | A63B 53/14 473/303 |
| 2014/0206471 A1 * | 7/2014 | Jertson | ..... | A63B 60/16 473/300 |

FOREIGN PATENT DOCUMENTS

| | | | | |
|---|---|---|---|---|
| FR | 2766728 B1 * | 4/2000 | ..... | A63B 60/54 |
| GB | 1278337 A * | 6/1972 | ..... | A63B 49/08 |
| JP | 2002052105 A * | 2/2002 | | |

* cited by examiner

*Primary Examiner* — Stephen Blau
(74) *Attorney, Agent, or Firm* — Fay Sharpe LLP

(57) ABSTRACT

The disclosure describes a flexible tubular grip for a golf club, particularly a putter, having the tubular portion formed of relatively soft elastomer with a closure or end cap molded therewith or pre-cured and attached over the end of the tubular portion. The end cap has a raised ridge extending about a portion of the end cap periphery and may have a raised discrete central portion, both of which absorb impact when the club is dropped into a golf bag.

17 Claims, 7 Drawing Sheets

FLEXIBLE GRIP AND CAP THEREFOR

BACKGROUND

The present invention relates to a tubular flexible grip for attachment to the handle of a golf club and particularly to golf clubs having a tubular steel handle where the tubular handle is open when the flexible grip is attached. Golf clubs are usually carried or transported in a bag specifically designed for golf clubs. In use, the clubs are upon return to the bag, commonly dropped handle first by the user into the open end of the bag, thereby allowing the club to fall until the end of the grip impacts the bottom of the bag. The end of the flexible grip is typically closed by a cap which is either molded with the grip or attached to the grip during or after molding. Thus when the user drops the club grip end first into the golf bag, the end of the steel tubular handle of the club compresses the closed end of the grip when the grip impacts the bottom of the bag.

In providing a flexible tubular grip for a putter golf club, it has been found desirable to form the flexible grip of relatively soft elastomeric material to enhance the user's "feel" of the club when used for putting. In view of the limited stroke and relatively slow speed of movement of a putter as compared to other golf clubs which are swung with speed and force, the use of relatively soft elastomeric material for the grip enables the user to have an increased sense of the force applied to the club during the relatively short stroke. Flexible grips for putters are also commonly formed with a non-circular cross-section with a flattened portion of the periphery to facilitate gripping of the club by the user during the putting stroke.

The increased number of times the putter is used, as compared to other clubs, results in many more times the club is removed and dropped into the golf club bag and more frequent occurrences of compressing the closed end of the grip by the end of the steel shaft; and, after many such impacts, rupture or punching through of the shaft against the closed end has a frequent occurrence. Thus, it has been desired to provide a way or means of protecting the closed end of the flexible grip employed for a golf club, particularly a putter having a relatively soft grip, to prevent the closed end from being ruptured by the club shaft when the club is dropped in the bag.

Furthermore, it has been desired to provide a contour shape to the closure or cap for a putter grip to add to the aesthetic appeal of the grip.

BRIEF DESCRIPTION

The present disclosure describes a flexible elastomeric grip for a golf club such as a putter with the end closure for the tubular grip having a raised ridge formed around the portion of the periphery of the closure or cap. The tubular grip may have, in one version, a non-circular cross-section with a portion of the periphery flattened. In this version, the raised ridge extends continuously over the flattened portion. In one version, the raised ridge extends at least half the periphery of the cross-section of the grip. The central region of the closure or cap for the grip may also have a discrete raised portion which, in one version, has a domed or spherical shape and in another version, an ellipsoid configuration. The raised dome provides for a bumper or cushion to protect the cap from being ruptured by the open end of the steel club shaft when the club is dropped handle first into a golf bag. The raised central portion may have graphics molded thereon to add information describing the grip, particularly when used for a grip of a putter. The raised portion particularly with a domed shape undergoes some deflection to absorb the impact of the club handle striking the bottom of the club bag. The raised ridge may have a width in the range of 2-6 millimeters, and in one version has a width of 3-5 millimeters. The raised ridge may have a height in the range of 1-3 millimeters; and, in one version, has a height in the range of 1.5-2 millimeters. The discrete central portion may extend 1-2 millimeters below the ridge and may also extend 2-4 millimeters above the ridge. In one version, the discrete central portion extends above the ridge an amount in the range of 2-3 millimeters. The ridge extends over at least 25% of the periphery of the closure member of cap; and in one version, the ridge extends about half the periphery of the grip. The grip tubular member may have a durometer hardness not greater than 45 on the Shore "A" scale; and, in one version the tubular member has a durometer hardness in the range of 30-35 on the Shore "A" scale. The closure member or cap may have a durometer hardness not less than 50 on the Shore "A" scale; and, in one version, the cap has a durometer hardness in the range of 60-80 on the Shore "A" scale.

DETAILED DESCRIPTION

Figure 1:
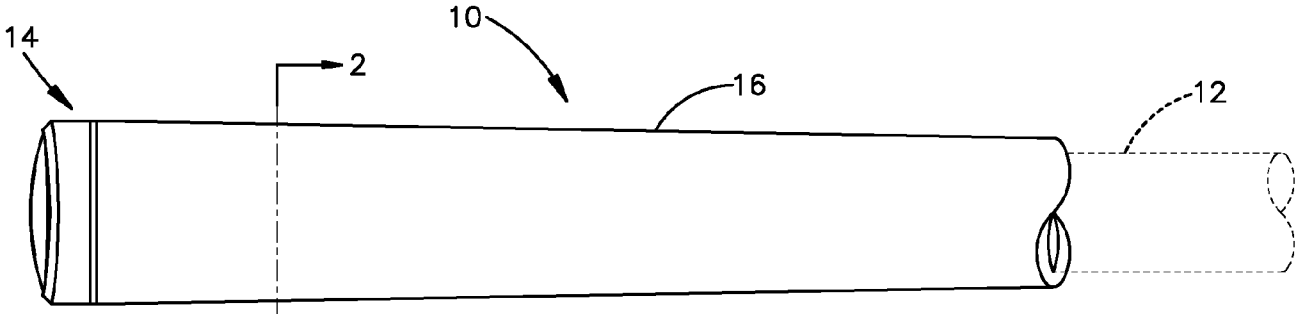
FIG. 1 is a side view of a flexible grip of the present disclosure showing a contoured end closure as received over the end of a golf club shaft shown in dashed outline.

With reference to FIG. 1, the flexible tubular grip of the present disclosure is indicated generally at 10 has a tubular body portion 16 as received over the typically metal shaft 12 of a golf club, indicated generally in dashed outline in FIG. 1.

Figure 2:
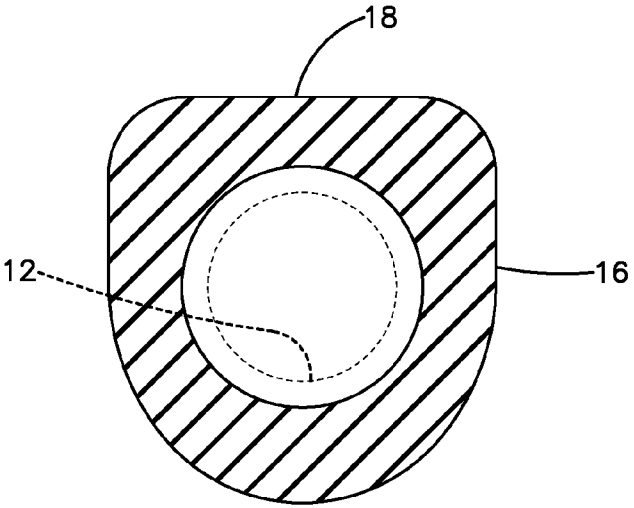
FIG. 2 is a section view taken along section indicating lines 2-2 of FIG. 1.

Referring to FIG. 2, the tubular member 16 is shown as having a non-circular cross-section with a flattened portion 18 of the cross-section periphery which is commonplace for the configuration of the grip as employed for a putter golf club.

Figure 3:
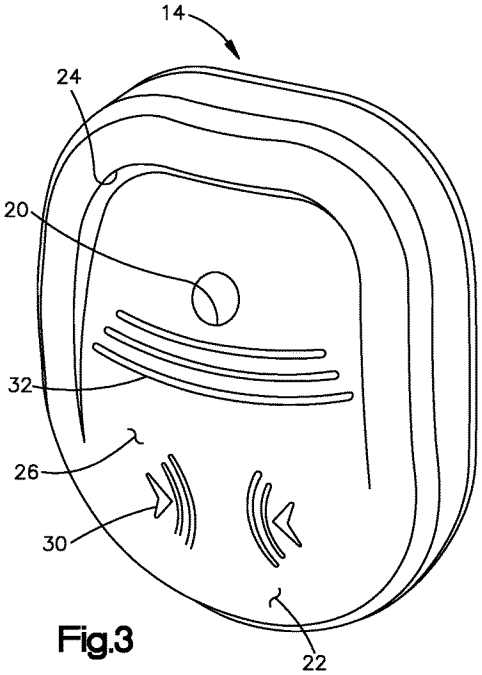
FIG. 3 is a perspective view of the end closure of the grip of FIG. 1.

Referring to FIG. 3, one version of an end cap 14 for closing the free end of the tubular body portion 16 (not shown in FIG. 3) is shown as having a non-circular configuration with a flattened portion 18 and includes an aperture 20 therethrough for providing air circulation to the interior of the club shaft. The cap 14 has a base surface 22 or end face thereof provided with a peripheral raised ridge 24 which extends continuously around a portion of the periphery of the cap 14. In the version of FIG. 3, the raised ridge 24 extends continuously around at least one half the periphery of the cap 14 and includes the flattened portion 18.

The cap 14 of FIG. 3 has a discrete central portion or region 26 of the end face or base surface 22 provided with a curved surface which may be raised slightly above the top of the ridge 24; and, in the version shown in FIG. 3 comprises a dome shape. In the present practice, it has been found satisfactory for the curved discrete central portion 26 or dome shaped portion to have a height in the range of 3-6 millimeters and, in one version, has a width of 4-5 millimeters. In the present practice, it is satisfactory to have the raised ridge 24 with a height in the range of 1-3 millimeters; and, in one version, ridge 24 has a height in the range of 1.5-2 millimeters. This height is measured from the low point of surface 22 to the maximum height of the dome 26 measured parallel to the axis of the grip.

In the present practice, it has been found satisfactory to have the discrete central portion or domed portion 26 extend one of 2 millimeters below the height of the ridge and 3 millimeters above the height of the ridge. In one version, the discrete central portion, in the form of the dome 26, extends above the height of the ridge an amount in the range of 2-3 millimeters. In the present practice, it has been found satisfactory to have the ridge extend over at least 25% of the periphery of the closure member or cap.

In the present practice, it has been found satisfactory to form the tubular flexible body 16 of elastomeric material having a durometer hardness not greater than 45 on the Shore "A" scale; and in one version, the tubular member 16 has a durometer hardness in the range of 30-35 on the Shore "A" scale. The closure member or cap 14 may have a durometer hardness not less than 50 on the Shore "A" scale; and, in the one version, the cap has a durometer hardness in the range of 60-80 on the Shore "A" scale.

Figure 4:
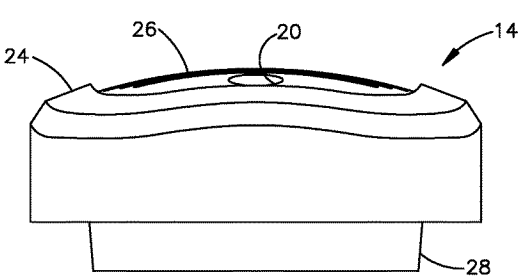
FIG. 4 is a top view of the closure of FIG. 3.
Figure 5:
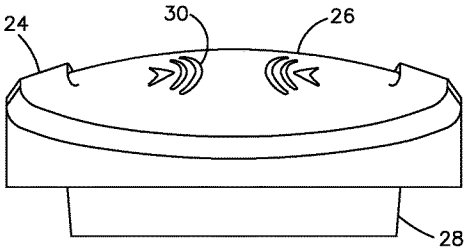
FIG. 5 is a bottom view of the closure of FIG. 3.
Figure 6:
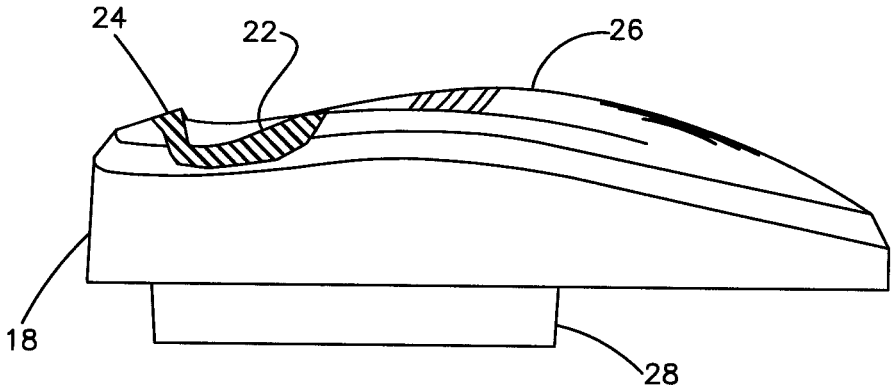
FIG. 6 is a left side view of the closure of FIG. 3.
Figure 7:
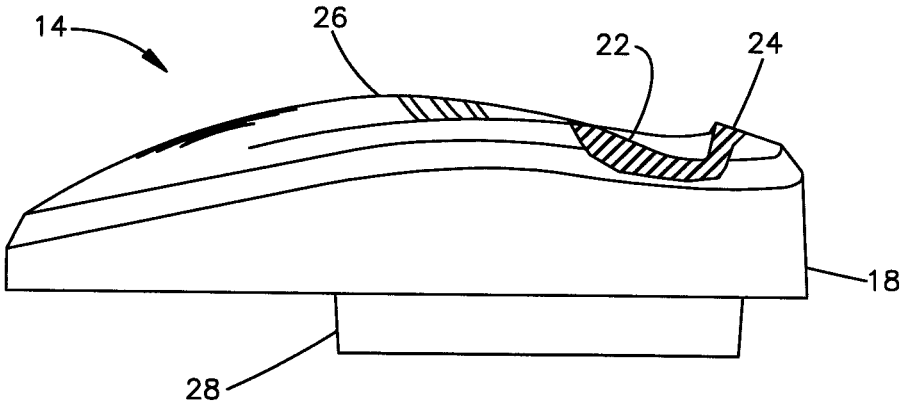
FIG. 7 is a right side view of the closure of FIG. 3.
Figure 8:
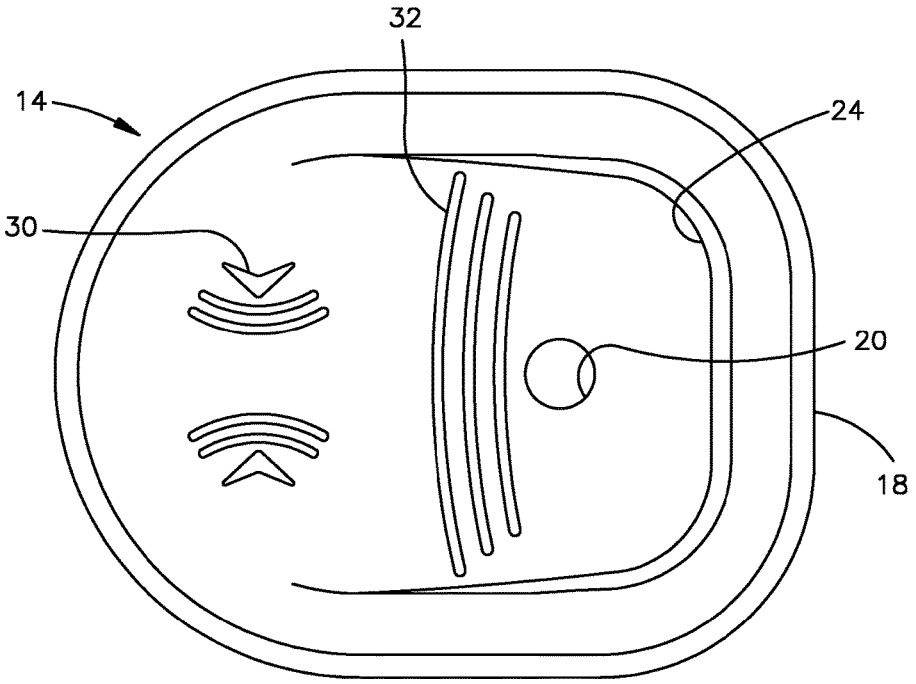
FIG. 8 is a front view of the closure of FIG. 3.
Figure 9:
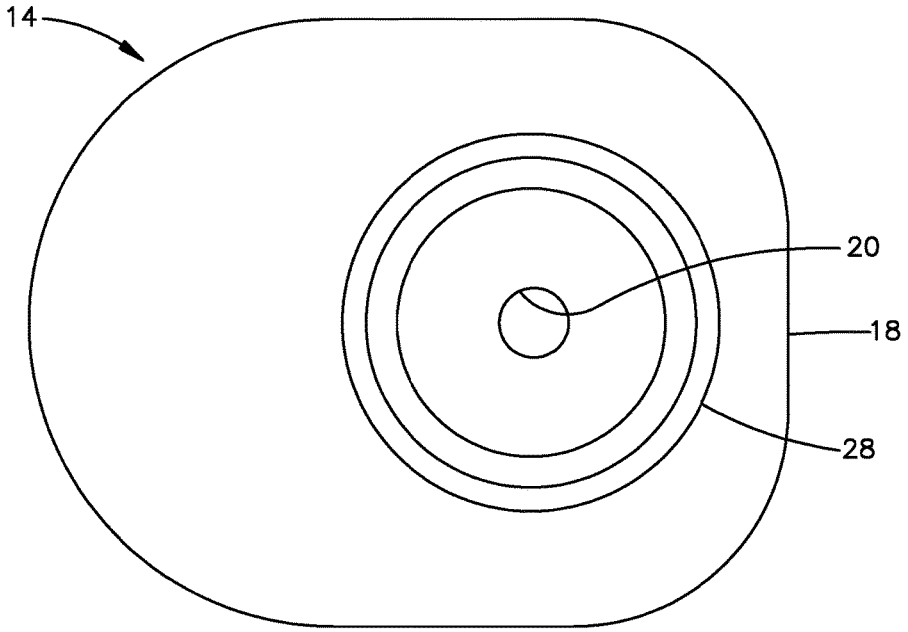
FIG. 9 is a back or reverse side view of the closure of FIG. 3.
Figure 11:
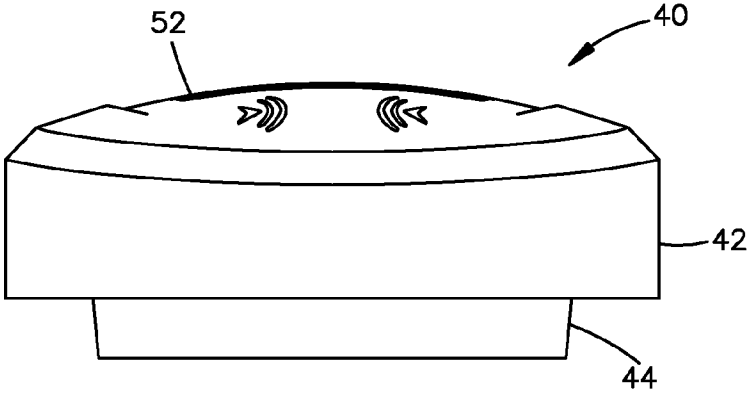
FIG. 11 is a top view of the closure of FIG. 10.
Figure 12:
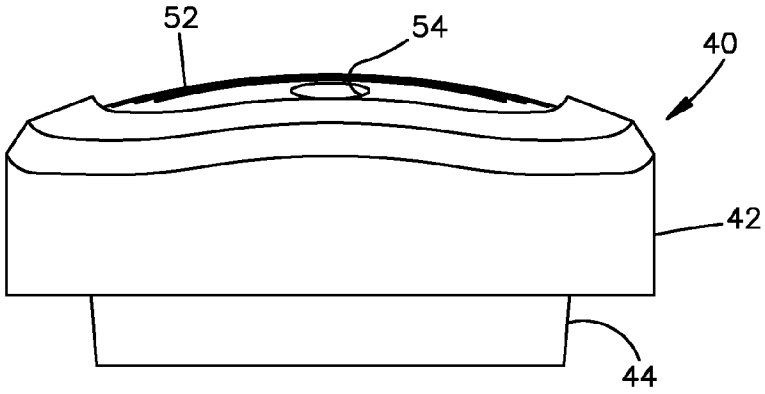
FIG. 12 is a bottom view of the closure of FIG. 10.

Referring to FIGS. 4 and 5, the cap 14 has a reduced diameter cylindrical portion 28 provided on the side opposite the end face; and, the reduced diameter cylindrical portion 28 is sized and configured to be received in the inner periphery of the end of the tubular body 16. The reduced diameter cylindrical portion 28 is located to allow the curved surface 26 to overhang further on the side distal the flattened portions as shown in FIGS. 6 and 7. The cap or closure member 14 may be pre-cured and subsequently cured in place with the flexible body 16 or may be pre-cured and adhesively bonded to the end of the tubular member 16. If desired, decorative indicia 30, 32 may be provided on the end face 22 of the closure or end cap 14. The reduced diameter cylindrical portion 28 may vary in length and diameter as desired. Alternatively, the reduced diameter cylindrical portion may be eliminated.

Referring to FIGS. 6 and 7, portions of the ridge 24 have been broken away to show the termination of the discrete central portion or dome 26 onto the end face or base surface 22. It will be noted that in the versions illustrated in FIGS. 3-7 that the base surface 22 or end face is curved such that the curvature of the domed surface terminates concurrently into the end of the cap opposite the end having the flattened portion 18 such that the flattened portion 18 has a greater thickness than the edge of the cap on the opposite side and giving an ellipsoidal configuration to the curved portion 14.

Figure 10:
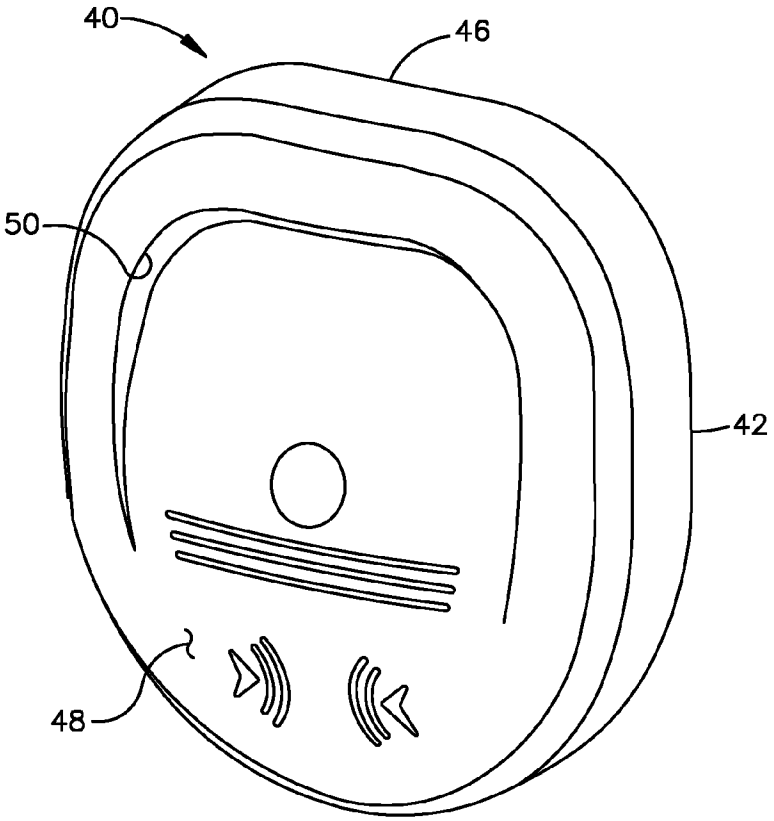
FIG. 10 is a perspective view of another version of the closure or cap of FIG. 1.
Figure 13:
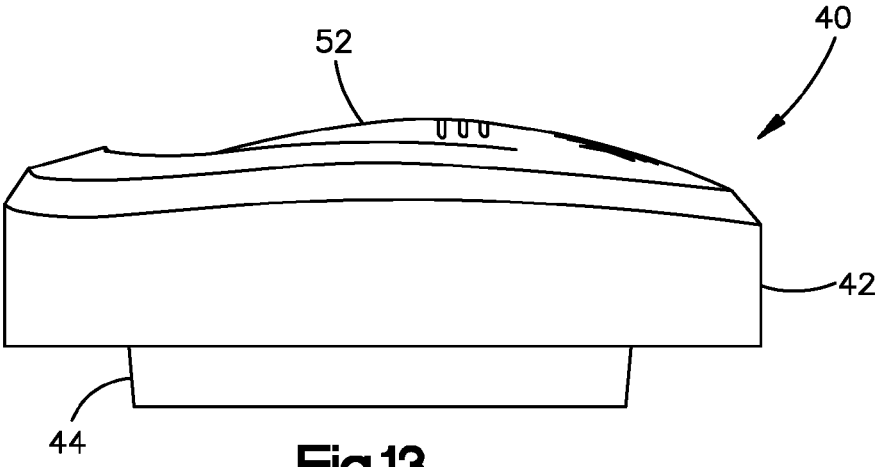
FIG. 13 is a right side view of the closure of FIG. 10.
Figure 14:
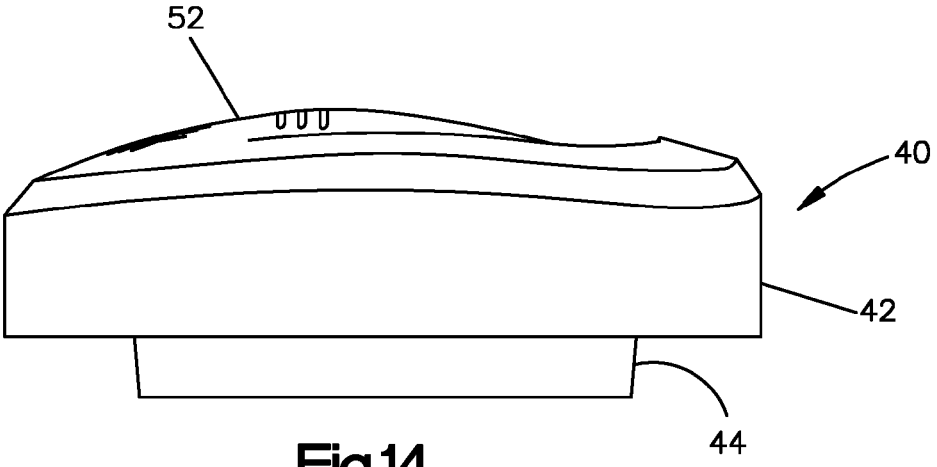
FIG. 14 is a left side view of the closure of FIG. 10.
Figure 15:
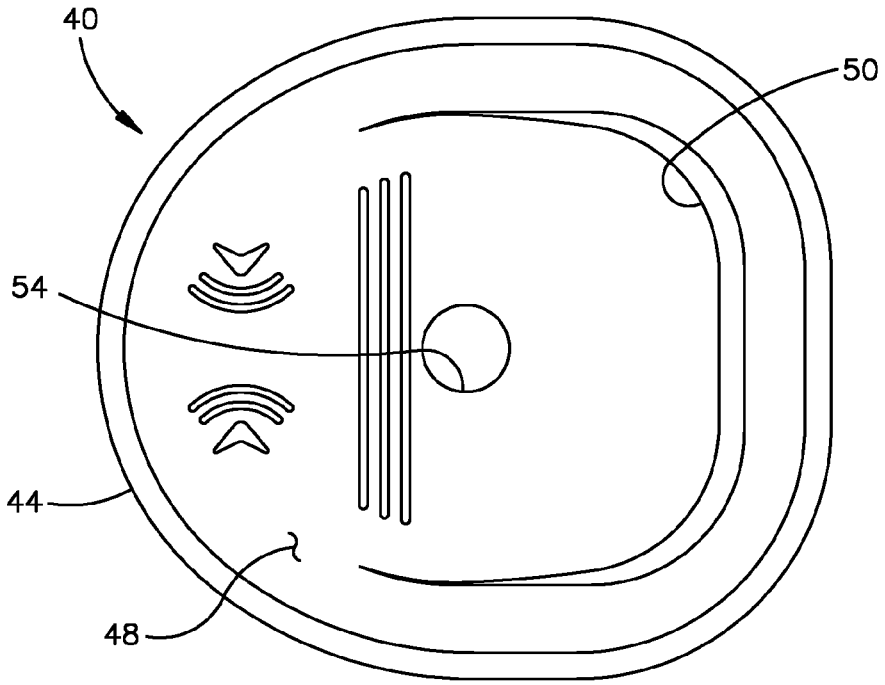
FIG. 15 is a front view of the closure of FIG. 10.
Figure 16:
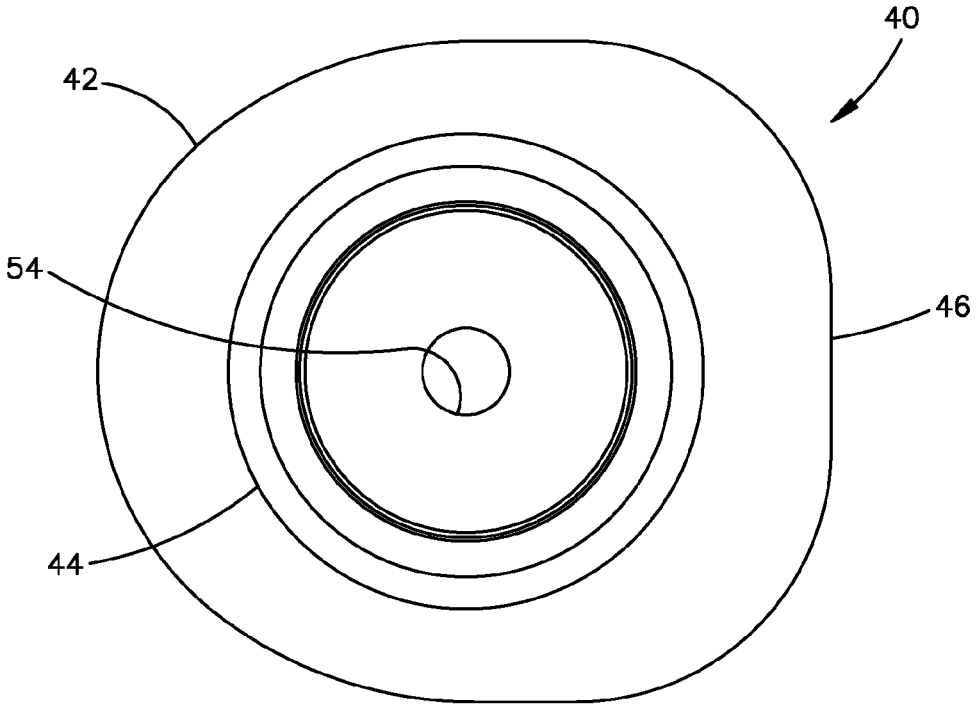
FIG. 16 is a back or reverse side view of the closure of FIG. 10.

Referring to FIGS. 10-16, another version of the end cap for the grip 10 is indicated generally at 40 and has an upper portion 42 which is configured to conform to the outer periphery of the tubular member 16 and a reduced diameter cylindrical portion 44 which is configured to be received in the inner periphery of the tubular member 16. The cap 40 has a flattened portion of the periphery 46 to conform with the configuration of a putter grip and has the end face 48 thereof formed in a generally flat plane configuration such that the periphery of the upper portion 42 is generally constant in thickness. The cap 40 has a raised ridge 50 provided about a portion of the periphery and extends continuously over the flattened portion 46 as shown in FIG. 10. The cap 40 has a raised discrete central portion 52 with an aperture 54 provided therein for air circulation as described hereinabove with respect to the version 14. A discrete central portion is domed and extends to the lower edge of the cap opposite of the flattened portion; however, the periphery of the upper portion 42 has a substantially uniform thickness about the periphery. Ridge 50 and discrete central portion may have the same height and width as the version 14 previously described.

The present disclosure thus describes a flexible tubular grip for a golf club, particularly a putter, with a relatively soft tubular portion with the closure or end cap thereon having a peripherally raised ridge on the end face thereof extending over at least 25% of the periphery and has a discrete central portion which is raised and curved such that the discrete central portion absorbs the impact and prevents the tubular metal shaft of the club from rupturing or punching through the end of the grip when the club is dropped in a golf bag. The grip of the present disclosure with the ridged and domed end cap thus also have decorative indicia provided on the end face of the closure or cap. The closure or cap may be integrally molded with the tubular portion of the grip or may be pre-cured and adhesively attached after molding of the tubular portion.

The exemplary versions have been described with reference to the drawings. Obviously, modifications and alterations will occur to others upon reading and understanding the preceding detailed description. It is intended that the exemplary versions be construed as including all such modifications and alterations insofar as they come within the scope of the appended claims or the equivalents thereof.

The invention claimed is:

1. A flexible grip for attachment to the handle of a golf club comprising:

(a) a tubular body formed of flexible elastomer having an open end for receiving the handle;

(b) a one-piece closure member formed of pre-cured elastomer provided on an end of the tubular member opposite the open end, wherein the closure member has at least a portion of the periphery raised from a base surface thereby forming a ridge extending over at least twenty-five percent (25%) of the periphery and the member has integrally formed therewith a discrete central portion raised from the base surface, the discrete central portion having a curved surface; and (c) the region intermediate the ridge and the discrete central portion being base surface, wherein the ridge is operative to cushion the impact encountered upon the club being dropped handle-first into a golf club bag.

2. The flexible grip of claim 1, wherein the tubular member has a non-circular cross-section with a portion of the periphery flattened and the ridge extends over and conforms to the shape of the flattened portion.

3. The flexible grip of claim 1, wherein the ridge extends continuously around at least one half of the periphery.

4. The grip of claim 1, wherein the discrete central portion includes a domed portion operative to undergo some deflection and absorb a portion of the impact upon the club being dropped handle-first into a golf club bag.

5. The grip of claim 4, wherein the domed portion extends above the ridge.

6. The grip of claim 4, wherein the domed portion extends one of (a) above, (b) at a common height, and (c) below the height of the ridge.

7. The grip of claim 1, wherein the tubular body has a durometer hardness not greater than 45 on the Shore "A" scale.

8. The grip of claim 1, wherein the closure member has a durometer hardness not less than 50 Shore "A" and not greater than 80 on the Shore "A" scale.

9. The grip of claim 1, wherein the ridge has a width in the range of 2-6 millimeters.

10. The grip of claim 1, wherein the ridge has a width in the range of 3-5 millimeters.

11. The grip of claim 1, wherein the ridge has a height in the range of 1-3 millimeters from the base surface.

12. The grip of claim 1, wherein the ridge has a height in the range of 1.5-2.0 millimeters from the base surface.

13. The grip of claim 1, wherein the discrete central portion extends one of 2 millimeters below the ridge and 3 millimeters above the ridge.

14. The grip of claim 1, wherein the discrete central portion extends above the ridge an amount in the range of 2-3 millimeters.

15. A flexible grip for attachment to the handle of a golf club comprising:

(a) a tubular body formed of flexible elastomer having an open end for receiving the handle; and, (b) a one-piece closure member of pre-cured elastomer having a durometer hardness not less than 50 Shore "A" and not greater than 80 Shore "A" provided on an end of the tubular member opposite the open end, wherein the closure member has at least a portion of the periphery raised from a base surface thereby forming a ridge about a portion of the periphery, wherein the ridge is operative to cushion the impact encountered upon the club being dropped handle-first into a golf club bag.

16. The flexible grip of claim 15, wherein the ridge has a width in the range of 2-6 millimeters.

17. The flexible grip of claim 15, wherein the ridge has a height in the range of 1-3 millimeters from the base surface.

* * * * *